United States Patent [19]

Civitelli

[11] 4,259,762

[45] Apr. 7, 1981

[54] SHOCK-ABSORBING HINGE-PIN DOORSTOP

[76] Inventor: Gennaro Civitelli, 336 Mountain Rd., Hamden, Conn. 06514

[21] Appl. No.: 138,230

[22] Filed: Apr. 7, 1980

[51] Int. Cl.[3] ..... E05D 13/00; E05D 11/00

[52] U.S. Cl. ..... 16/86 B; 16/137; 16/85

[58] Field of Search ..... 16/86 B, 86 R, 86 A, 16/85, 137; 239/18

[56] References Cited

U.S. PATENT DOCUMENTS

| | | | |
|---|---|---|---|
| 2,813,293 | 11/1957 | Civitelli | 16/86 B |
| 3,805,322 | 4/1974 | Serrano | 16/86 A |

*Primary Examiner*—Doris L. Troutman

[57] ABSTRACT

A hinge-pin doorstop made of spring-steel bent to provide a loop through which the hinge pin on the door hinge fits for mounting purposes, and having a pair of resilient arms which extend radially from the loop in spaced relation to each other, so that when they are pinched between the door and the molding on the door frame, they absorb the shock of the door, thereby preventing damage to the door or frame.

3 Claims, 5 Drawing Figures

SHOCK-ABSORBING HINGE-PIN DOORSTOP

BACKGROUND OF THE INVENTION

The present invention relates to doorstops and it relates more particularly to the type of doorstop which is mounted on the hinge pin of the door like those shown in my prior U.S. Pat. Nos. 2,683,620 and 2,813,293.

A problem encountered with hinge-pin doorstops is that they tend to damage the door and/or frame at the points where the stop contacts them. This is particularly true where doorstops are used on hollow-core doors due to the fact that the outer panels on such doors are easily penetrated by the bumper on the doorstop under the very high force exerted by the door against the stop at the hinge. To my knowledge there has been no satisfactory prior solution to this problem, despite the fact that it has existed for many years.

An object of the present invention is to provide a hinge-pin doorstop which reduces or eliminates damage to the wood work on the door and frame.

SUMMARY OF THE INVENTION

The invention resides in forming a hinge-pin doorstop of a continuous length of spring steel having sufficient resilience to absorb the shock of the door when it is swung against the stop. A loop-portion of the stop is provided for mounting it on the hinge pin of the door. Extending from the loop-portion is a first arm-portion with a bumper-member mounted on it in position for engagement with the door. Also extending from the loop-portion is a second arm-portion, which carries another bumper-member disposed in spaced relation to the first for engagement with the door frame, such that when the door is opened the desired amount, the two arm-portions are resiliently squeezed between the door and frame.

DETAILED DESCRIPTION OF PREFERRED EMBODIMENTS

The advantages of the invention will be more apparent from the description hereinafter of the preferred embodiments of the invention, reference being had to the accompanying drawings, in which, FIG. 1 is a cross-sectional view of a portion of a door and door frame, on which my new hinge-pin stop has been mounted, the door being shown closed;

Figure 1:
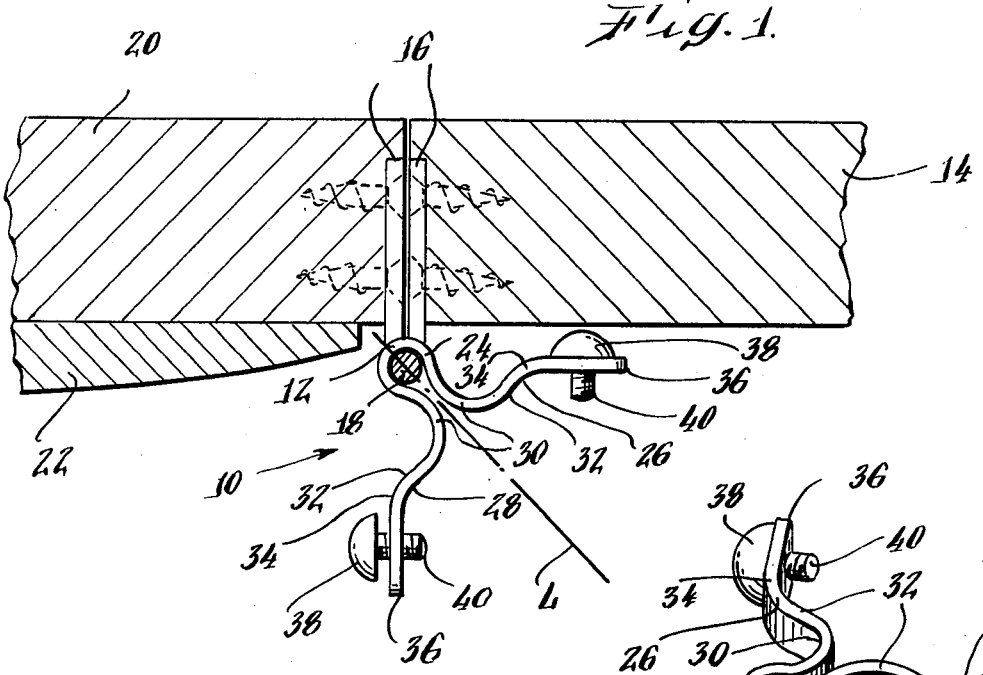
Figure 2:
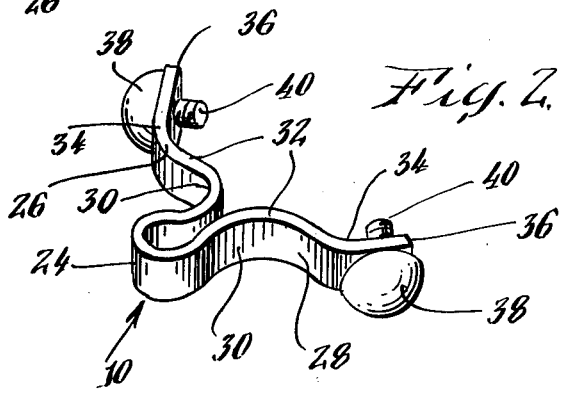
FIG. 2 is a perspective view of the hinge-pin doorstop shown in FIG. 1.
Figure 3:
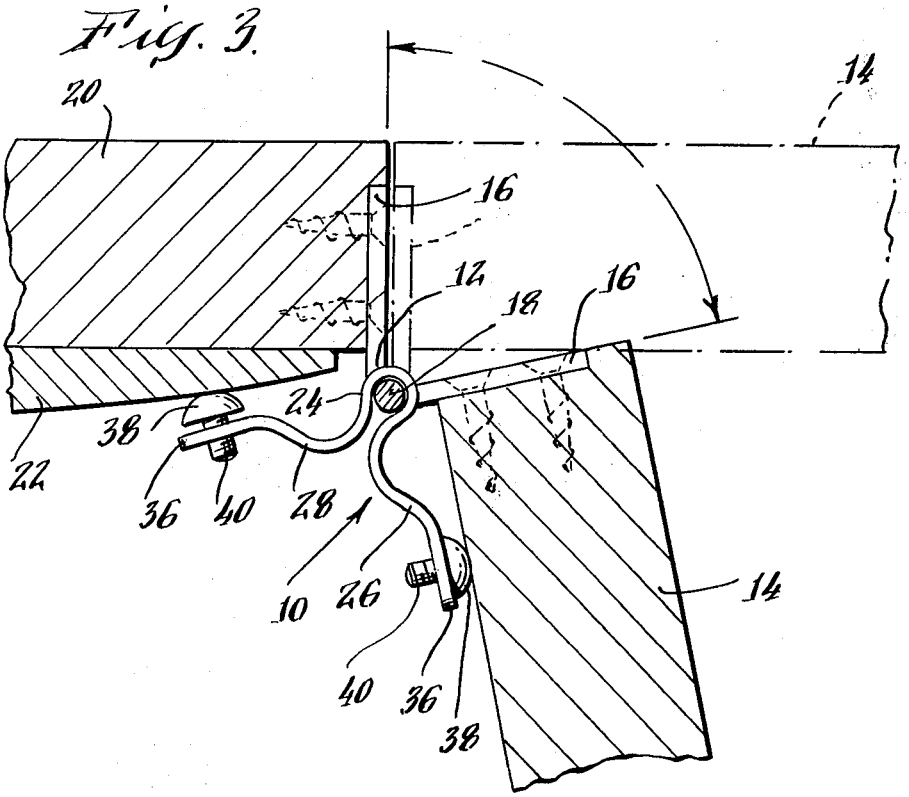
FIG. 3 is a view similar to FIG. 1, but showing the door open.

In the embodiment of the invention shown in FIGS. 1 to 3, a hinge-pin doorstop 10 is shown mounted on one of the hinges 12 of a door 14. Hinge 12 is a conventional door hinge having a hinge-plates 16, 16 pivotally connected by a hinge-pin 18, one of hinge-plates 16, 16 being fastened to the inner edge of the door by suitable wood screws, while the other is similarly fastened to the door frame 20. The usual molding board 22 is shown on the side of door frame 20. Doorstop 10 is designed to limit the swing of the door to approximately 90° of arc.

Doorstop 10 is made of a continuous length of relatively heavy, flat-stock spring-steel formed to provide a loop-portion 24, from which extend a pair of arms 26 and 28 in a generally radial direction. Loop-portion 24 forms a substantially closed circle, the inside diameter of which is slightly larger than the hinge pin of a standard size door hinge, so that hinge pin 18 can be removed from hinge 12, inserted through the loop-portion 24 of doorstop 10 and then replaced on the hinge with the doorstop attached thereto. Loop-portion 24 surrounds more than half the hinge pin 18 in order to ensure that the doorstop 10 can not come loose therefrom.

In this instance, both arms 26 and 28 are of identical shape and length, each having a circular bend 30, having a curvature which is the reverse of the loop-portion 24, and tangent thereto. Bend 30 on each arm 26, 28 extends through approximately 100° of arc, the radius of which is about twice that of loop-portion 24. A short straight section 32 extends from each bend 30 such that both sections 32, 32 extend outward in exactly opposite directions on a line that is perpendicular to the centerline L of the stop 10. Each section 32 terminates in a 45° bend 34 that joins it with a straight end portion 36 disposed radially of hinge pin 18 and in this instance at right angles to the end portion on the other arm. A bumper 38, is adjustably mounted on each end portion 36 so that they face outwardly of each other, each bumper 38 being made of a suitable rubber or plastic material and having an integral mounting post 40, which is threaded into a tapped hole in each of the end portions 36, 36.

When the door 14 is swung open as illustrated in FIG. 3 it engages the bumper on arm 26 of the doorstop 10, pivoting it until the bumper on the other arm 28 engages the molding board 22, thereby preventing the door from opening further, such action being similar to that of conventional hinge-pin doorstops which are rigid. However, if the foor is swung open rapidly or with considerable force, the arms 26, 28 of my stop yield by resiliently bending toward each other under the force exerted against them by the door, thereby absorbing much of the tremendous force generated near the hinge pin. Consequently, the bumpers 38, 38 are not driven against the side of the door 14 and the molding board 22 with the impact they receive from rigid stops employed heretofore, and therefore they do not permanently damage the surfaces of these members or leave unslightly marks on them.

A limited amount of adjustment for the place at which the door is stopped is provided by the threaded posts 40, 40 on which bumpers 38, 38 are mounted. For example, by unscrewing one or both of the bumpers 38, they will extend a short distance from the end portions 36, 36 on the respective arms 26 and 28, increasing the distance between them and reducing the arc through which the door can swing before both bumpers engage. By rotating both bumpers in the opposite direction until they seat against the ends of arms 26, 28, the door is permitted to swing farther. It is important that at least the end-portions 36, 36 of the arms 26, 28 extend in directions which are radial to the hinge-pin 18 so that the threaded mounting posts 40, 40 on bumpers 38, 38 extend perpendicular to the surfaces they engage.

Figure 4:
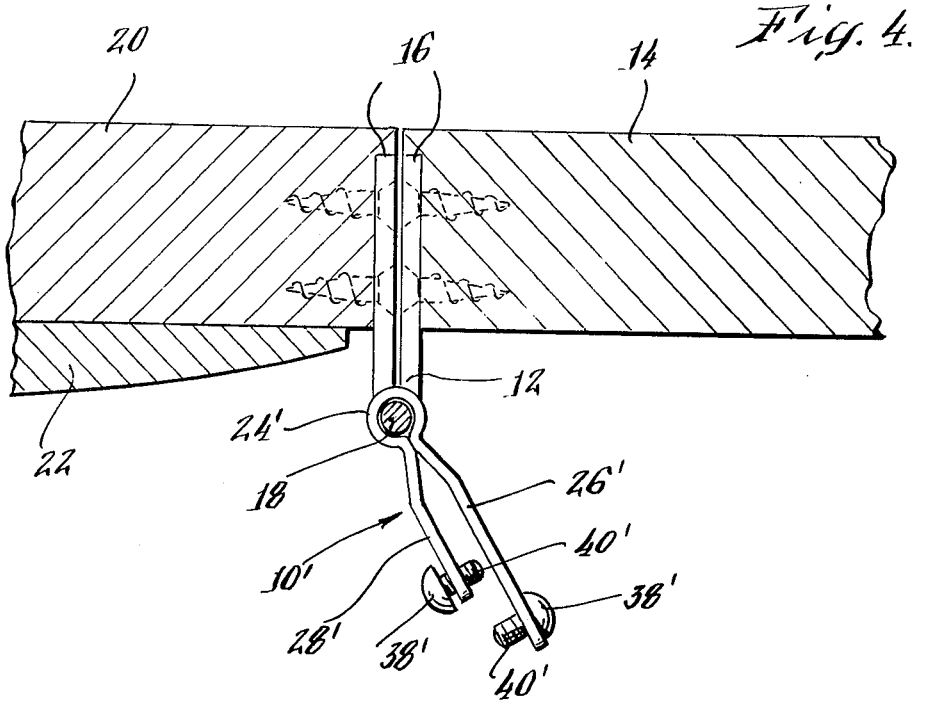
FIG. 4 is a view similar to FIG. 1, but showing a second embodiment of a hinge-pin doorstop in accordance with the invention.
Figure 5:
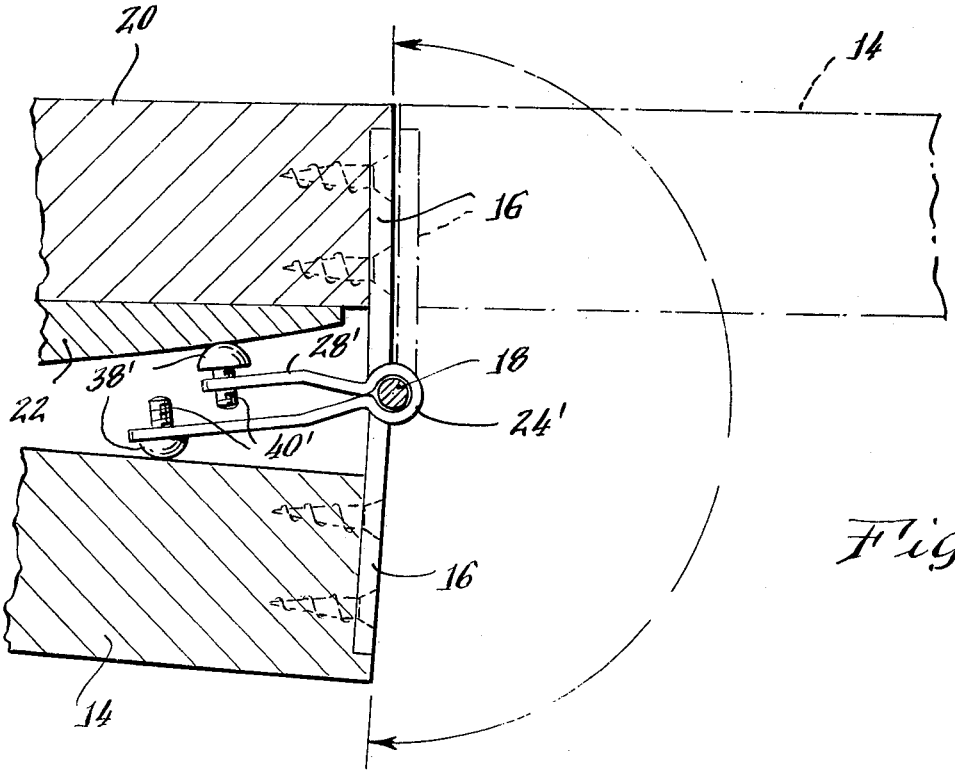
FIG. 5 is a view similar to FIG. 4, but showing the door open.

It will be apparent that where it is desired to let the door swing back 180° against the wall, the resilient arms of a hinge pin doorstop embodying my invention can be formed so that they extend substantially straight out from the hinge pin as illustrated in FIGS. 4 and 5. Thus, the doorstop 10' like the one shown in FIGS. 1-3 is made of a continuous length of heavy spring-steel with a loop-portion 24', through which the hinge pin 18 fits, and a pair of arms 26' and 28' extending radially from loop-portion 24'. In this instance arms 26', 28' are both straight throughout most of their length with bumpers 38', 38' at the outer ends for engagement with the door 14 and frame 20, respectively. In order to avoid interference between the mounting posts 40', 40', arm 28' should be somewhat shorter than arm 26'. However, arms 26' and 28' may be of equal length if adjustment of bumpers 38', 38' is not required. In that event mounting posts 40', 40' can be shortened or replaced with mounting studs (not shown) which do not project beyond the rear surface of each arm 26' or 28'.

As will be seen in FIG. 5 the doorstop 10' permits door 14 to swing back through an arc approaching 180° before both bumpers 38', 38' engage the molding 22 on door frame 20, at which point arms 26' and 28' are flexed slightly under the force of door 14, thereby absorbing the impact and preventing damage to the door or molding.

I claim:

1. A hinge-pin doorstop formed from a continuous length of steel and having a loop-position adapted to encircle the hinge pin, a first arm-portion extending generally radially from said loop-position, a bumper-member mounted on said first-arm portion in position for engagement with the door, a second arm-portion extending generally radially from said loop-portion into spaced relationship with respect to said first arm-portion, a second bumper-member mounted on said second arm-portion in position for engagement with the door frame, said arm-portions being disposed such that when the door is swung open the desired amount said arm-portions are squeezed between the door and frame resiliently stopping the door from opening farther, the resilience of said arm-portions being sufficient to absorb enough of the force exerted by the door against them to prevent damage to the surfaces of the door and frame at the points engaged by said bumper-members.

2. A hinge-pin doorstop as defined in claim 1, wherein each of said bumper-members is separably mounted on its arm-portion for relative displacement arcuately about said loop-portion in order to adjust the amount by which the door may open.

3. A hinge-pin doorstop as defined in claim 2, wherein each of said bumper-members is mounted on one end of an elongated screw threaded to the corresponding one of said arm-portions with its longitudinal axis extending tangentially of said hinge pin.

* * * * *